United States Patent [19]

Pankoke

[11] Patent Number: 4,632,722

[45] Date of Patent: Dec. 30, 1986

[54] ARRANGEMENT FOR APPLYING A SURFACE PRESSURE UPON MOVABLE WORKPIECES

[75] Inventor: Werner Pankoke, Bielefeld, Fed. Rep. of Germany

[73] Assignee: Theodor Hymmen, Bielefeld, Fed. Rep. of Germany

[21] Appl. No.: 747,933

[22] Filed: Jun. 20, 1985

[30] Foreign Application Priority Data

Jul. 4, 1984 [DE] Fed. Rep. of Germany ..... 3424599

[51] Int. Cl.[4] ..... B30B 5/06; B30B 15/34

[52] U.S. Cl. ..... 156/555; 100/93 RP; 100/154; 156/583.5; 277/DIG. 7; 425/371

[58] Field of Search ..... 156/555, 583.5; 100/93 RP, 154; 425/371; 277/DIG. 7

[56] References Cited

U.S. PATENT DOCUMENTS

| | | | |
|---|---|---|---|
| 2,981,307 | 4/1961 | Malarkey, Jr. | 100/154 |
| 3,748,225 | 7/1973 | Busker et al. | 100/154 |
| 3,839,147 | 10/1974 | Daane | 100/154 |
| 4,485,733 | 12/1984 | Held | 100/154 |

*Primary Examiner*—Michael Wityshyn
*Attorney, Agent, or Firm*—Michael J. Striker

[57] ABSTRACT

An arrangement for applying a surface pressure upon movable workpieces, has a rotatable pressing band with a working run applying a pressure against the workpiece, a pressure chamber formed by a part of the working run, a pressing plate, and a sealing member arranged on an edge of the pressing plate, and a lubricant supplying system including at least one lubricating nozzle formed in the sealing member and at least one lubricant discharge opening provided in the sealing member with its surface abutting against the pressing band.

18 Claims, 10 Drawing Figures

ARRANGEMENT FOR APPLYING A SURFACE PRESSURE UPON MOVABLE WORKPIECES

BACKGROUND OF THE INVENTION

The present invention relates to an arrangement for applying a surface pressure to movable workpieces, such as for example wood material plates and the like. More particularly, it relates to an arrangement for applying a surface pressure to movable workpieces, which has at least one rotatable pressing band which acts on a workpiece under the action of pressure of a pressure medium supplied from a pressure chamber, wherein the pressure chamber is formed by a part of a working run of the pressing band, a rectangular pressing plate arranged at an opposite side from the working run, and a sealing member arranged on longitudinal and transverse edges of the pressing plate.

In the known arrangement of the above mentioned general art, lubricating oil is supplied in the vicinity of the sealing member and then transported from the pressing band to the sealing members so that an oil film is formed in the region of a surface of the sealing member, which abuts against the pressing band. The known arrangements have the disadvantage that the contact surfaces between the pressing band and the sealing member are lubricated very non-uniformly. At the location with a greater distance between the sealing member and the pressing band, more oil is supplied than at the locations with a smaller distance. Moreover, the known arrangements have the disadvantage that during supply of the oil in the pressure pads a whriling or intensive mixing of oil with oxygen takes place. This leads to oxidation and thereby to premature aging of the lubricating oil.

SUMMARY OF THE INVENTION

Accordingly, it is an object of the present invention to provide an arrangement for applying a surface pressure to movable workpieces, which avoids the disadvantages of the prior art.

More particularly, it is an object of the present invention to provide an arrangement for applying a surface pressure to movable workpieces, in which lubrication at the locations of friction between the sealing member and the pressing band is considerably improved.

In keeping with these objects and with others which will become apparent hereinafter, one feature of the present invention resides, briefly stated, in an arrangement in which a sealing member is provided with one or several lubricating nozzles or with one or several lubricant guiding passages, and a surface of the sealing member abutting against the pressing band is provided with one or several outlet openings for the lubricating medium.

When the arrangement is designed in accordance with the present invention, the lubricating medium is supplied directly to the friction points between the sealing member and the pressing band and therefore by a respective pressure application of the lubricating medium the thickness of the lubricant film between the sealing member and the pressing band is exactly adjusted. This lubricant film performs its functions as a lubricant medium for reducing the friction of the sealing member against the pressing band and as a sealing medium against escape of the air from the pressing chamber in an optimal manner.

In accordance with the present invention there is also a possibility to use as a pressure medium for the lubricant the pressure air accommodated in the pressure chamber and/or to supply the lubricating nozzles provided in the sealing member from a separate lubricating medium circulation circuit.

When the arrangement is designed in accordance with the present invention, the wear of the sealing member is reduced and overheating under the sealing member is eliminated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
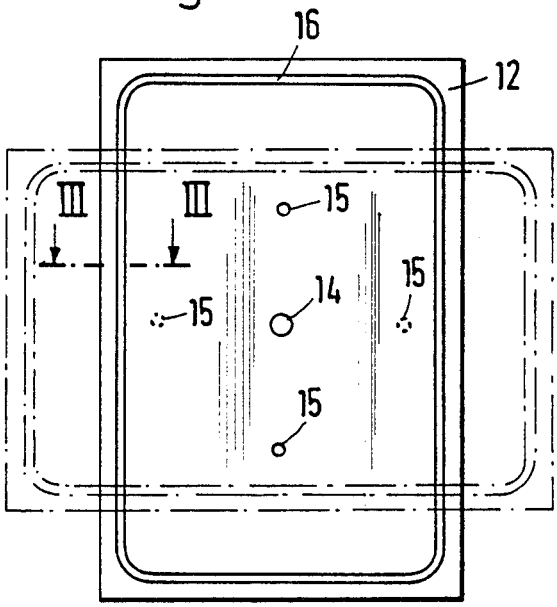
FIG. 1 shows a pressing plate turnable about a central axis, as seen from the side of a pressing band.

An arrangement shown in FIG. 1 has a lower frame 2 and an upper frame 3. Endless pressing bands 4 are mounted in the frames 2 and 3, respectively. The pressing bands 4 rotate around deviating rollers 5 and are driven by the latter. The pressing bands 4 are arranged with a gap which corresponds to the width of a workpiece 6 to be treated. When the pressing bands 4 perform a horizontal movement with the surfaces which contact the workpiece 6, the wordpiece 6 is pulled into the arrangement and more particularly into the gap between the surfaces, wherein a pressure is applied by the surfaces of the pressing bands upon the workpiece. During passage of the workpiece 6 through the arrangement its working takes place so that the workpiece leaves the gap between the pressing bands 4 as a final product.

Figure 2:
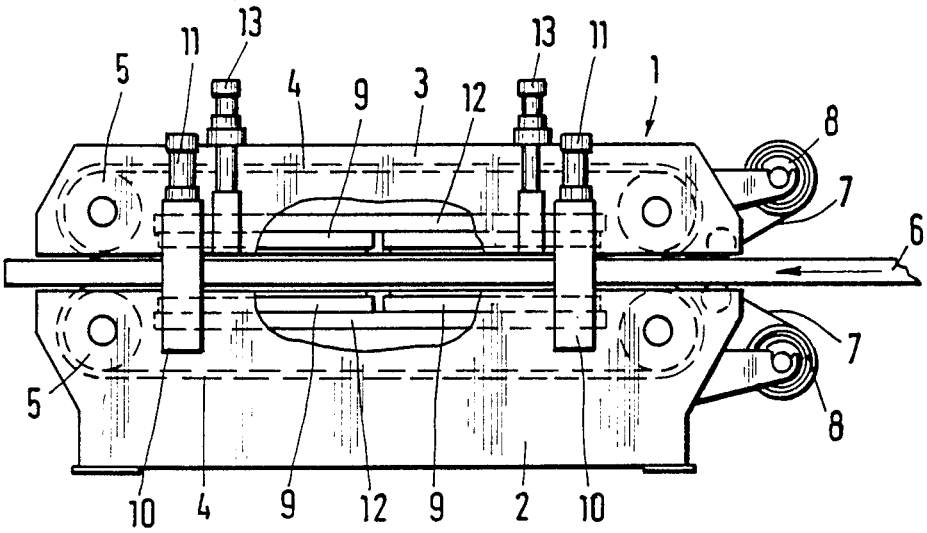
FIG. 2 is a side view of the arrangement in accordance with the present invention with an upper and a lower pressing band.

In the arrangement in accordance with the embodiment shown in FIG. 2, foils 7 are prssed onto the upper and lower sides of the workpiece 6. The foils 7 are supplied from supply rollers 8. The pressing process can be performed with room temperature or higher temperatures acting upon the workpiece in the treatment region. For obtaining the desired pressure, the upper frame 3 as a whole can be pressed against the lower frame 2, and after adjustment of the dimension of the distance between the upper frame 3 and the lower frame 2, the required pressure can be applied by an air pressure formed in pressure chambers 9. The pressure chambers 9 are arranged at the pressing band 4 and particularly at its rear side relative to the workpiece 6.

In the illustrated embodiment the size adjustment of the gap is performed by means of guiding carriages 10 which are fixedly arranged on the lower frame 2. The upper frame 3 is displaceable on the carriages 10 in a vertical direction. A hydraulic cylinder-piston unit 11 is provided for the displacement of the upper frame 3. The pressure chambers 9 are limited at their side facing away from a working run of the pressing band, by pressing plates 12. The pressing plates 12 are movable relative to the frames 2 and 3 by means of a hydraulic cylinder-piston unit 13.

As shown in FIG. 1, the pressing plate 12 is rotatable about an axle 14 extending normal to the working run of the pressing band 14. Thereby, with its rectangular shape having different side lengths, adjustment of the pressure chamber width to different workpiece widths can be performed. A presure medium can be supplied via openings 15 through the pressing plate 12, into the pressure chamber 9.

The pressing plate 12 is provided with a peripheral groove 16. In the embodiment shown in FIG. 3, a hose 17 with a round cross-section is arranged in the groove 16. The hose is composed of rubber or synthetic plastic. The borders of the groove 16 correspond to the contour of the round hose. The height h of the groove corresponds to substantially ⅔ the outer diameter of the hose 17. The hose is supported with its end extending outwardly beyond the groove 16, on the pressing band 4.

The hose is provided with a sealing strip 18 which is formed of one-piece with the hose. Lubricating nozzles 19 are arranged in the sealing strip at a distance from one another. They supply lubricating oil from an inner chamber 20 of the hose.

Figure 3:
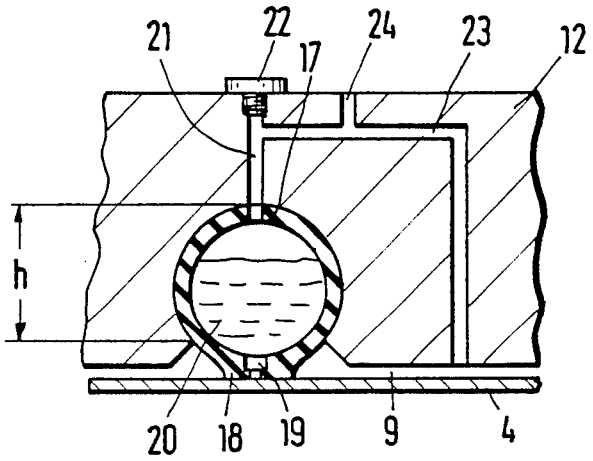
FIG. 3 is a view showing a section taken along the line III—III in FIG. 1.

In the embodiment shown in FIG. 3, the inner chamber 20 of the hose 17 is filled in its greater part with lubricating oil. This lubricating oil is supplied via a channel 21 to the inner chamber of the hose. A filling opening of the channel 21 is closed by a screw 22. The conduit 23 opens into the channel 21 for supplying the pressure air through a pipe 24, both to the oil-free space of the inner chamber 20 and to the pressure chamber 9. The lubricating oil accommodated in the inner chamber 20 of the hose is thereby subjected to the action of pressure and pressed through the lubricating nozles 19 onto the friction surfaces between the sealing strip 18 and the pressing band 4 to form an oil film in this region. The oil film reduces the wear of the sealing strip and also provides a gastight sealing of the pressure chamber 9.

Figure 4:
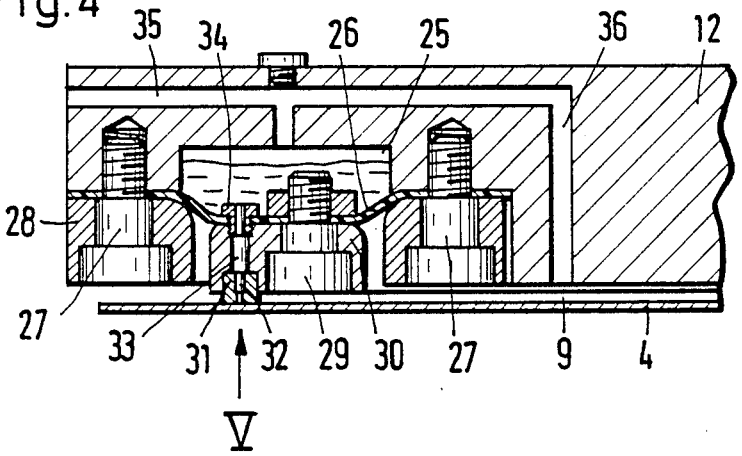
FIG. 4 is a view showing the arrangement in accordance with another embodiment of the invention differing from FIG. 3.

In the embodiment shown in FIG. 4, the pressing plate 12 has a peripheral groove 25 which is closed at its side facing toward the pressing band 4 by a membrane 26. The membrane 26 forms a rubber-elastic seal and is fixed to the pressing plate 12 by screws 27 and strips 28 in gas and liquid-tight manner. A mount 30 is fixed on the membrane 26 by screws 29. The mount has a peripheral groove. A strip-shaped sealing shaped member 31 with rectangular profile is fixed in the groove of the mount. Lubricating nozzles 32 are arranged in the sealing shaped member at a distance from one another. The lubricating nozzles supply the lubricating oil respectively through a channel 33 and through a nipple 34, screwed in the channel. The groove which is limited from below by the membrane 26 is partially filled with lubricating oil. The lubircating oil-free part of the groove is subjected to the action of pressure air which is supplied via a channel 35 and via a branching channel 36 into the pressure chamber 9.

Figure 5:
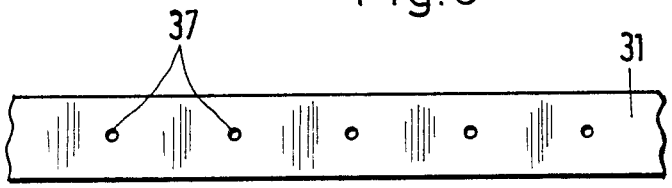
FIG. 5 is a view showing a strip-shaped sealing member in direction of the arrow V in FIG. 4.
Figure 6:
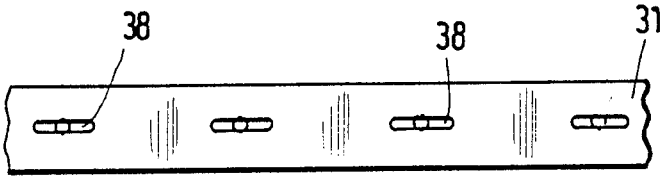
FIGS. 6 and 7 are views showing the embodiments different from the embodiment of FIG. 5.

Each lubricating nozzle 19, 32 has an outlet opening 37 at its side facing toward the pressing band 4. The outlet openings 37 in the embodiment shown in FIG. 5 have a round cross-section. As can be seen from FIG. 6, the outlet openings can be formed as wide slots 38 as well. The lubricating nozzles 19, 32 can be arranged at a distance of between 100 and 200 mm from one another.

Figure 7:
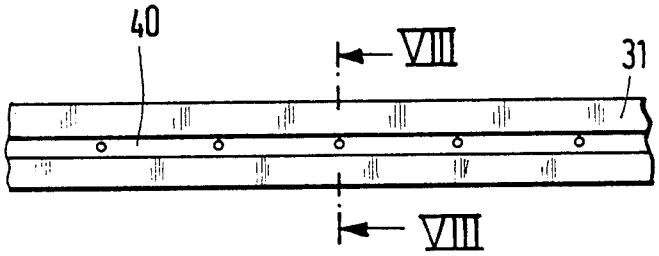
Figure 8:
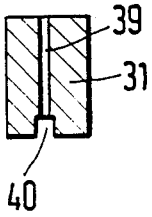
FIG. 8 is a view showing a section taken along the line VIII—VIII in FIG. 7.

In the embodiment shown in FIG. 7, the sealing shaped member 31 is provided with lubricating nozzles 39 which are open in a distributing groove 40. The distributing groove 40 extends over the entire length of the sealing shaped member 31.

Figure 9:
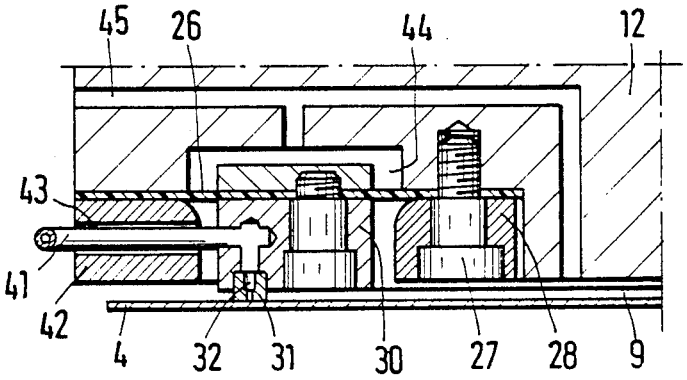
FIGS. 9 and 10 are views showing the embodiments in accordance with which a separate lubricant medium circulating circuit is provided.

In the embodiment of FIG. 9, the lubricating nozzles 32 arranged in the strip-like sealing shaped member 31 are subjected to the action of a system with lubricating medium which is dependent on the pressure medium available in the pressure chamber 9.

Lubricating medium, for example, lubricating oil, is supplied via a conduit 41 which passes through an opening 43 in the strip 42. The opening 43 has an inner diameter which is greater than the outer diameter of the conduit 41. Thereby there is a possibility that the conduit 41 can follow the movement of the mount 30 or the sealing shaped member 31, the movement taking place under the pressure loading of the rubber-elastic member 26. A chamber 44 together with the pressure chamber 9 are loaded with pressure air which is supplied through a channel 45.

Figure 10:
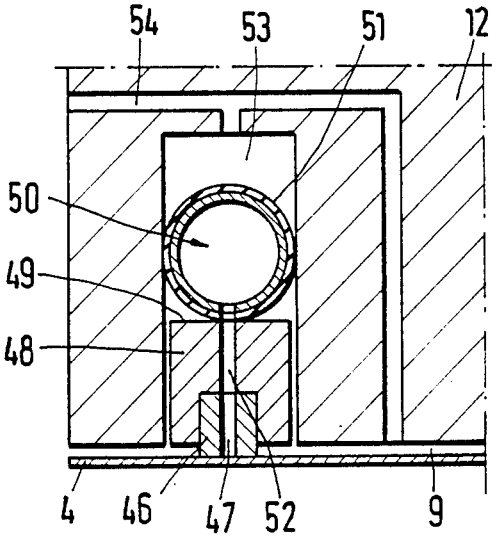

In the embodiment shown in FIG. 10, a sealing strip 46 is provided with channels 47 which guide the lubricating oil and are arranged along the sealing strip at a distance from one another. The sealing strip is anchored in a mount 48, a rigid pipe 50 is supported on an upper limiting surface 49 of the mount 48 and provided with a synthetic plastic casing 51. Lubricating oil is supplied through the pipe 52 to the individual channels 47 which are connected with the inner chamber of the pipe 50 by conduits 52. The synthetic plastic casing 51 of the pipe 50 forms a sealing of the chamber 53 which is loaded via a conduit 54 with pressure air, together with the pressure chamber 9.

It will be understood that each of the elements described above, or two or more together, may also find a useful application in other types of constructions differing from the types described above.

While the invention has been illustrated and described as embodied in an arrangement for applying a surface pressure to movable workpieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An arrangement for applying a surface pressure to movable workpieces, comprising at least one rotatable pressing band having a working run arranged to act on a workpiece; means forming a pressure chamber which accommodates a pressure gas applying a pressure to said pressing band, said means including a part of said working run of said pressing band, a pressing plate spaced from said working run in a direction opposite to the workpiece and having an edge, and a sealing member provided on said edge of said pressing plate and having a surface which abuts against said pressing band; means for supplying a liquid lubricant to said pressing band, said liquid lubricant supplying means including at least one liquid lubricant guiding part provided in said sealing member, and at least one liquid lubricant discharging opening provided in said surface of said sealing member.

2. An arrangement as defined in claim 1, wherein said lubricant supplying means includes a plurality of such lubricant guiding parts provided in said sealing member, and a plurality of said lubricant discharging openings provided in said surface of said sealing member.

3. An arrangement as defined in claim 1, wherein said lubricant guiding part is formed as a lubricating nozzle provided in said sealing member.

4. An arrangement as defined in claim 1, wherein said lubricating guiding part is formed as a passage provided in said sealing member.

5. An arrangement as defined in claim 1, wherein said pressing plate has a rectangular shape with longitudinal and transverse edges, said sealing member extending along said longitudinal and said transverse edges of said pressing plate.

6. An arrangement as defined in claim 1, wherein said sealing member is formed as a hose having a region provided with said surface and having an inner chamber accommodating the lubricant, said lubricant supplying means having a plurality of such discharging openings provided in said region of said hose.

7. An arrangement as defined in claim 1, wherein said sealing member includes a plurality of sealing strips, said lubricant supplying means including a plurality of such lubricant guiding parts which are formed as lubricating nozzles arranged in said sealing strips at a distance from one another.

8. An arrangement as defined in claim 7; and further comprising a membrane on which said sealing strips are mounted, said lubricating nozzles extending through said membrane, said membrane forming a lubricant containing chamber which is at least partially filled with the lubricant.

9. An arrangement as defined in claim 8, wherein said chamber which is formed by said membrane is completely filled with the lubricant.

10. An arrangement as defined in claim 1, wherein said lubricant supplying means includes a plurality of such lubricant guiding parts formed as lubricating nozzles, said lubricant supplying means including a plurality of such lubricant discharging openings formed in said lubricating nozzles and having a round shape.

11. An arrangement as defined in claim 1, wherein said lubricant supplying means includes a plurality of such lubricant guiding parts formed as lubricating nozzles, said lubricant supplying means including a plurality of such lubricant discharging openings formed in said lubricating nozzles and having the shape of wide slots.

12. An arrangement as defined in claim 1, wherein said lubricant supplying means includes a plurality of such lubricant guiding parts formed as lubricating nozzles and arranged at a distance of between 100 and 200 mm.

13. An arrangement as defined in claim 1, wherein said lubricant supplying means includes a plurality of such lubricant guiding parts formed as lubricating nozzles, said sealing member being provided with a distributing groove in which said lubricating nozzles are open.

14. An arrangement as defined in claim 1; and further comprising means for supplying pressure air so as to act upon the lubricant.

15. An arrangement as defined in claim 1, wherein said lubricant supplying means has a plurality of such lubricant guiding parts formed as lubricating nozzles; and further comprising a separate lubricant system arranged to supply lubricant to said lubricating nozzles.

16. An arrangement as defined in claim 1, wherein said lubricant supplying means include a plurality of such lubricant guiding parts formed as lubricant guiding passages; and further comprising a separate lubricant system arranged to supply lubricant to said passages.

17. An arrangement as defined in claim 1; and further comprising a holding member which urges said sealing member against said pressing plate.

18. An arrangement as defined in claim 17, wherein said pressing plate has a peripheral groove, said holding member being arranged in the region of said peripheral groove of said pressing plate.

* * * * *